United States Patent [19]

Hara et al.

[11] 4,034,933

[45] July 12, 1977

[54] REEL MOUNTING MEANS FOR A WIRE TAKE UP APPARATUS

[75] Inventors: Ryoichi Hara; Masamichi Yajima, both of Ichihara, Japan

[73] Assignee: The Furukawa Electric Co., Ltd., Tokyo, Japan

[21] Appl. No.: 641,483

[22] Filed: Dec. 17, 1975

[30] Foreign Application Priority Data

Dec. 18, 1974 Japan ..... 49-152541[U]

[51] Int. Cl.[2] ..... B65H 49/00

[52] U.S. Cl. ..... 242/129.8; 242/125.3

[58] Field of Search ..... 242/68, 68.1, 68.4, 242/129.51, 129.53, 125.1, 125.2, 125.3, 134, 129.8

[56] References Cited

U.S. PATENT DOCUMENTS

| | | | |
|---|---|---|---|
| 1,456,108 | 5/1923 | Johannesen | 242/125.2 |
| 2,213,764 | 9/1940 | Hermann | 242/134 |
| 2,650,035 | 8/1953 | Egee | 242/129.51 |
| 3,098,621 | 7/1963 | Nelson et al. | 242/79 |
| 3,695,542 | 10/1972 | Briggs | 242/78.6 |

*Primary Examiner*—Leonard D. Christian

*Attorney, Agent, or Firm*—Woodling, Krost, Granger & Rust

[57] ABSTRACT

In reel mounting means for a wire take up apparatus comprising a pair of spindles axially movable so that the opposing ends of said spindles are received into an axial hole in a reel and so that a relatively thicker wire such as an electric wire or an electric cable extending through an opening in one of the flanges of said reel with the end of said wire leading out of said reel flange is fixed between said reel flange and the corresponding spindle, characterized by that at least one of said spindles on the side facing the corresponding reel flange is provided with a pressurizing plate to be exerted so that it is pressed against said reel flange. The pressurizing plate includes a reel flange pressurizing body to be forced against said reel flange and a wire end securing body to force said wire end against said corresponding reel flange whereby it is fixed between said pressurizing plate and said corresponding reel flange.

2 Claims, 8 Drawing Figures

REEL MOUNTING MEANS FOR A WIRE TAKE UP APPARATUS

BACKGROUND OF THE INVENTION

In taking up on a reel a relatively thicker wire such as an electric wire or an electric cable fed continuously from an insulation extruder of an electric wire manufacturing apparatus, the reel should be mounted on a wire take up apparatus before taking it up thereon. Conventional reel mounting means serves only to rotatably bear the reel on a pair of spindles received into the axial hole in the reel and as a result, thereafter the wire end is threaded through a lateral opening in one of the reel flanges to be led out of the flange and fixed with a cord bonded at one end to the wire end and at the other end secured by nails to the reel flange in a manually operated manner. Thus, with conventional reel mounting means, after bearing the reel on the spindles, the wire end should be fixed to the reel flange by manual operation, with the result that the reel mounting operation has been troublesome and ineffective. Also, since the wire end is secured to the reel flange while the wire is continuously manufactured by extrusion, the wire manufactured by and fed from the manufacturing apparatus has been disadvantageously much slackened to cause buckling and deterioration of the wire. Furthermore, since on fixing the wire end on the reel flange it tends to be injured, the reel could not be repetitively used so that it has been uneconomical. In addition, in the case that the reel flanges are made of metal or plastics, the wire end should be secured to the reel flange in a manner that one end of a cord which at the other end is lapped on and secured to the wire end, is bonded to a hook which is in turn secured to the reel flange either by threaded extension through the reel flange or by welding, which has caused the operation to be troublesome.

SUMMARY OF THE INVENTION

Accordingly, it is a principal object of the present invention to provide reel mounting for a wire take up apparatus adapted to substantially automatically fix an end of a wire to one of flanges of a reel as well as bear the reel on the wire take up apparatus, so that the reel mounting operation is made easier and more effective.

It is another object of the present invention to provide reel mounting means for a wire take up apparatus adapted to prevent occurrence of undue bending or buckling on the wire being manufactured, when the reel is mounted on the apparatus, so that the wire take up can be smoothly accomplished.

It is another object of the present invention to provide reel mounting means for a wire take up apparatus adapted to fix an end of a wire to one of flanges of a reel, so that it can be repetitively used.

It is another object of the present invention to provide reel mounting means for a wire take up apparatus adapted to easily fix an end of a wire to one of flanges of a reel regardless of materials of the reel.

It is further object of the present invention to provide reel mounting means for a wire taking up apparatus adapted to securely fix an end of a wire so as not to be free from a reel flange during taking up the wire, so that the effectiveness in the wire taking up operation is improved.

It is further object of the present invention to provide reel mounting means for a wire take up apparatus adapted to reform a deformation applied to a reel as well as prevent an outward bend of the reel due to the take up tension during the wire up, whereby a wire can be taken up even on such a reel having a relatively smaller physical strength.

It is further object of the present invention to provide reel mounting means for a wire take up apparatus wherein a torque can be more effectively transmitted from spindles to a reel.

In accordance with the present invention, there is provided reel mounting means for a wire take up apparatus comprising a pair of spindles axially movable so that the opposing ends of said spindles are received into an axial hole in a reel and so that a relatively thicker wire extending through an opening in one of the flanges of said reel with the end of said wire leading out of said reel flange is fixed between said reel flange and the corresponding spindle, characterized by that at least one of said spindles on the side facing the corresponding reel flange is provided with a pressurizing plate including a reel flange pressurizing body to be forced against said reel flange and a wire end securing body to force said wire end against said corresponding reel flange whereby it is fixed between said pressurizing plate and said corresponding reel flange.

BRIEF DESCRIPTION OF THE DRAWINGS

The above and other objects and features of the present invention will be apparent from the description of the preferred embodiment taken with reference to the accompanying drawings in which.

DETAILED DESCRIPTION OF PREFERRED EMBODIMENTS

Figure 1:
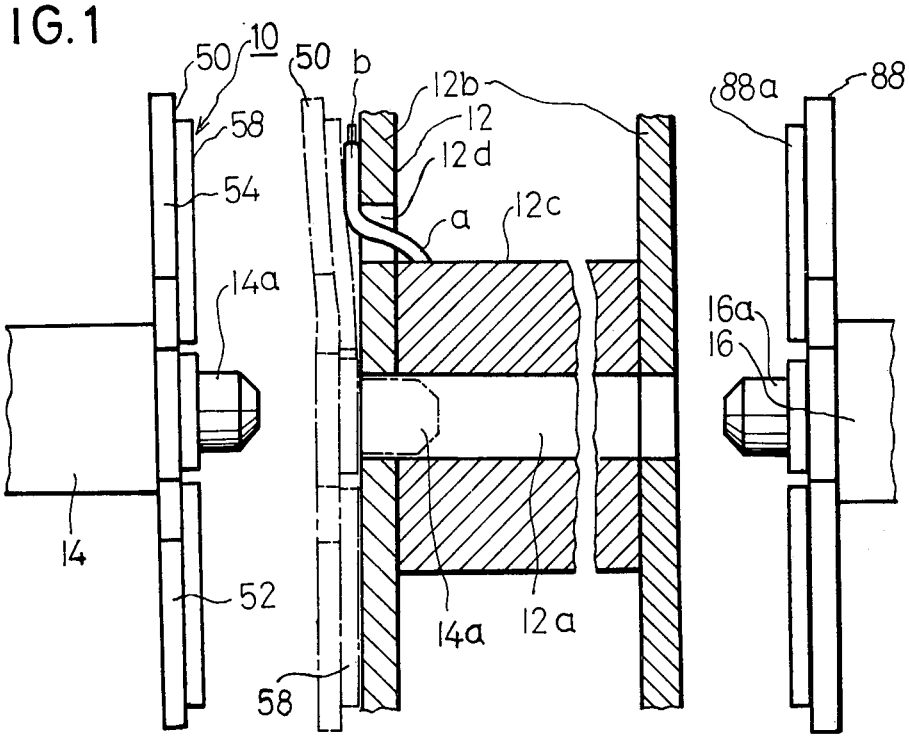
FIG. 1 is a vertically sectional view of a reel to take up a wire thereon and portions of reel mounting means operatively associated with the flanges of the reel.
Figure 1A:
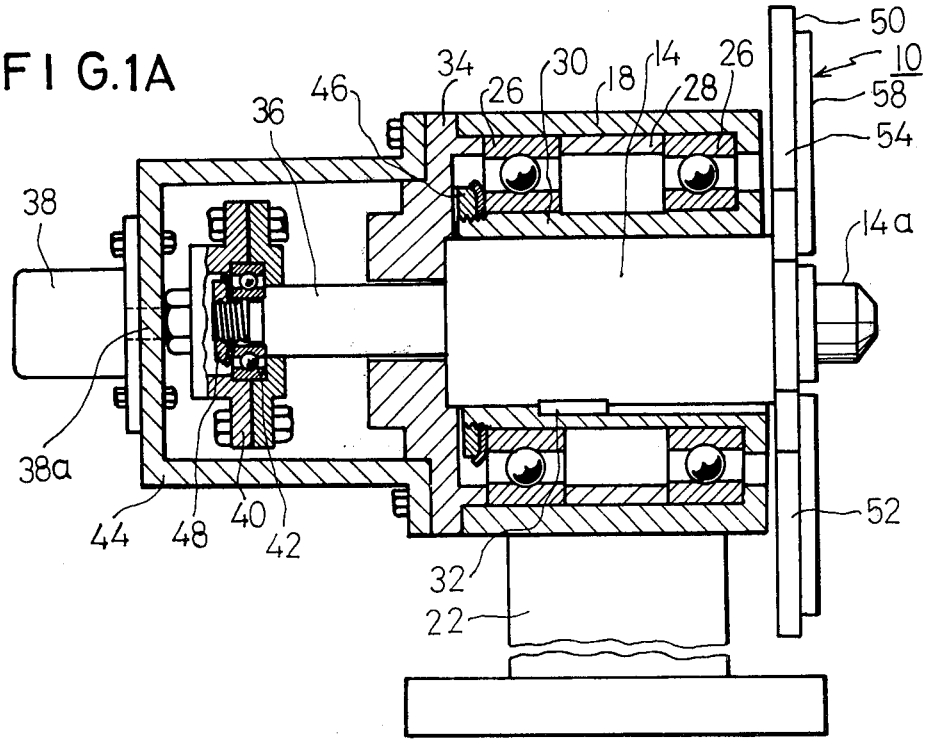
FIG. 1A is a vertically sectional view of a section of reel mounting means on the left side of FIG. 1.
Figure 1B:
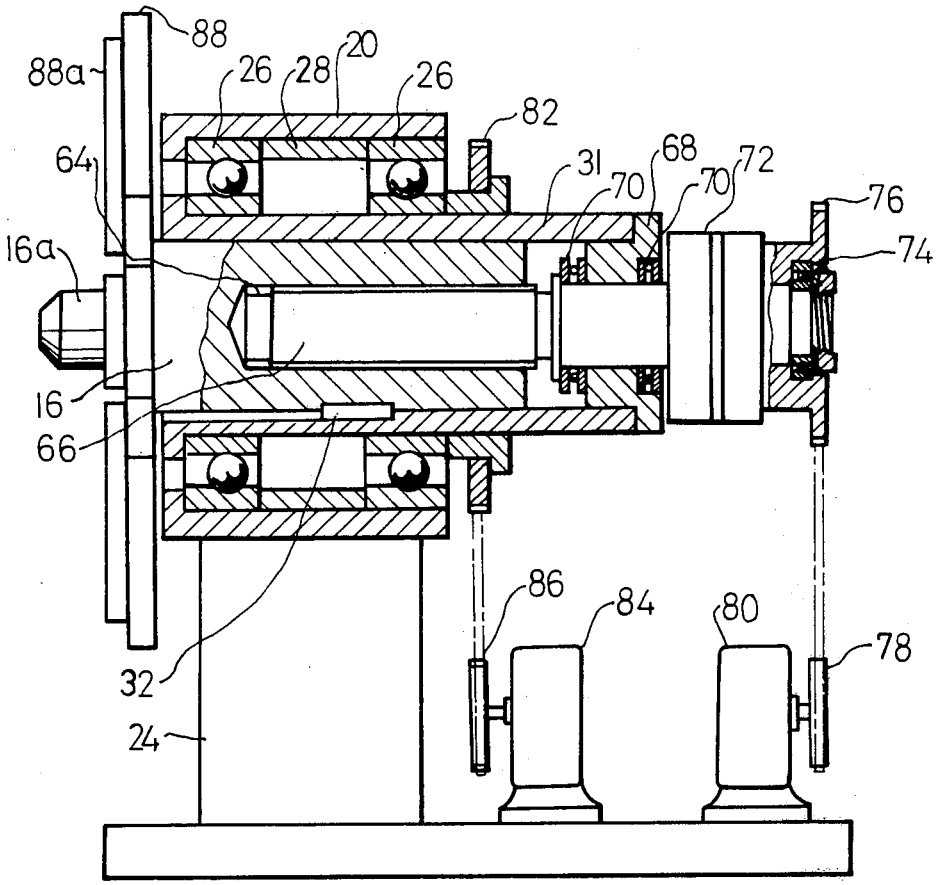
FIG. 1B is a vertically sectional view of another section of reel mounting means on the right side of FIG. 1.

Referring now to FIGS. 1, 1A, and 1B, there is shown reel mounting means 10 of the present invention for a wire take up apparatus. This reel mounting means may comprise fixed stands 22 and 24 provided on the tops with respective bearing assemblies 18 and 20 which rotatably support spindles 14 and 16, respectively, to mount a wire reel 12 thereon. As shown in FIGS. 1A and 1B, the bearing assemblies 18 and 20 each have two bearings 26 spaced from each other by a spacer member 28, and also have respective inner sleeves 30 and 31 fitted into the bearings 26. The inner sleeve 31 is shown to extend outward of the outside bearing. The spindles 14 and 16 axially slidably extend through the inner sleeves 30 and 31 with respective keys 32 positioned between the inner sleeves and the spindle assemblies 14 and 16. Reduced portions 14*a* and 14*a* on the spindles 14 and 16 adjacent to the inner ends thereof are to be received into an axial hole 12*a* axially provided in the wire reel 12 to rotatably bear it on the spindles 14 and 16 (FIG. 1).

FIG. 1A illustrates a section of reel mounting means 10 on the side of left end of the reel 12 in more detail, and the spindle 14 at the outer end may comprise a reduced extension 36 extending through a bearing holder cover 34. The reduced extension 36 may be rotatably supported on a bearing 42 in a bearing coupling 40 which may be in turn connected to a piston rod 38*a* of a linear power supply 38 such as a pneumatic or hydraulic cylinder. The linear power supply 38 may be fixedly flanged to a protecting cover 44 which is in turn flanged to the bearing assembly 18 together with the bearing holder cover 34 so as to cover the reduced extension 36 of the spindle 14 as well as the bearing coupling 40. Of course, the piston rod 38*a* of the linear power supply slidably extends through the protecting cover 44. Thus, as the linear power supply is actuated in either direction, the reduced portion 14*a* is received into or removed from the axial hole 12*a* in the reel 12. Numeral 46 designates a holding nut threadedly engaged with the inner sleeve 30 to hold the bearings 26 and numeral 48 designates a holding nut threadedly engaged with the reduced extension 36 to hold the bearing 42.

A pressurizing plate 50 is secured to the spindle 14 at the base of the reduced portion 14a so that it faces the flange 12b of the reel. The reel 12 may be provided adjacent to the drum 12c with a lateral opening 12d through which an end *b* of a wire *a* to begin to be taken up is to extend. The end *b* of the wire extending through the opening 12*d* and leading out of the flange 12*b* is pressed against the flange 12b of the reel by the pressurizing plate 50.

Figure 2:
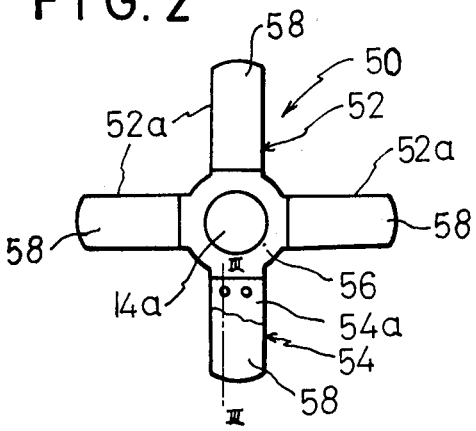
FIG. 2 is a front view of a pressurizinfg plate mounted on the left section of reel mounting means of FIG. 1A.
Figure 3:
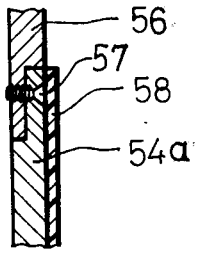
FIG. 3 is an enlarged sectional view of the pressurizing plate taken along the line III—III of FIG. 2.

As shown in FIG. 2 in more detail, the pressurizing plate 50 comprises a reel flange pressurizing body 52 and a wire end securing body 54. In the illustrated embodiment, the reel flange pressurizing body may comprise three arm-like pressurizing pieces 52*a* composed of rigid materials such as iron, steel or the like. The pressurizing pieces 52*a* may extend at the angular space of 90° integrally and radially from an annular base 56 secured to the spindle 14 by any suitable means. The wire end securing body 54 may comprise a resilient pressurizing piece 54*a* arranged in a circumferentially individual manner from the pressurizing pieces 52*a* of the reel flange pressurizing body 52. The resilient pressurizing piece 54*a* may be composed of leaf spring and positioned at the angular space of 90° from the two adjacent pressurizing pieces 52*a* and secured by screws 57 to the annular base 56 as shown in FIG. 3. The pressurizing pieces 52*a* and 54*a* at the surfaces facing the flange of the reel 12 may be preferably lined with resilient frictional members 58, as shown in FIG. 1, to assure prevention of slipping of the pressurizing pieces relative to the reel flange. It will be understood that the reel flange pressurizing body 52 may comprise a semi-circular or substantially circular plate which corresponds to integral combination of the three pressurizing pieces 52*a*. It will be also understood that the reel flange pressurizing body 52 may comprise a single rectangular piece as long as its physical strength is accepted.

Figure 4:
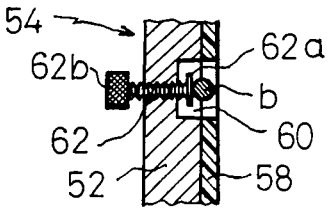
FIG. 4 is substantially similar to FIG. 3, but shows a modification in the pressurizing plate.

As shown in FIG. 4, the reel flange pressurizing body 52 may comprise a circular pressurizing member while the wire end securing body 54 may be mounted on the pressurizing body 52 rather than provided individually therefrom. More particularly, the reel flange pressurizing body 52 at the surface facing the lateral opening 12*d* in the reel flange may be provided with a lateral groove 60 to receive the end *b* of the wire and the wire end securing body 52 may comprise a screw 62 threadedly extending through the body 52 at the portion having the groove 60 and having a pressurizing piece 62a secured to the end of the screw 62 to press the wire end *b* against the reel flange and rotating means 62*b* such as a knob, an electric motor or a hydraulic mechanism to rotate the screw 62 Alternately, the wire end securing body 54 may comprise a screw as shown at numeral 62 in FIG. 4 which extends through a through hole (not shown) in the pressurizing bod 52 and threadedly engages a bracket (also not shown) secured thereto by any suitable means. Such wire end securing body may also force the wire end *b* against the reel flange 12*b*. Further alternately, the wire end securing body 54 may comprise a holder (not shown) disposed in the lateral groove or hole in the pressurizing body 52 to hold the wire end *b* at both sides thereof.

FIG. 1B illustrates a section of reel mounting means 10 on the side of the other or right end of the reel 12 in more detail and the spindle 16 at the outer end may have an axial threaded hole 64, through which extends a threaded shaft 66 which causes the spindle 16 to axially move on rotation of the shaft 66. The threaded shaft 66 at the non-threaded portion may be journalled on bearings 70 which are in turn mounted on a bearing member 68 provided on the outer end of the inner sleeve 31. The shaft 66 at the non-threaded outer portion may extend through and be connected to an electromagnetic clutch 72. The shaft 66 at the extreme end of the non-threaded portion may rotatably mount a sprocket 76 by means of a bearing 74. The sprocket 76 may be connected integrally with the rotary desk of the clutch 72 and also connected through a gearing 78 to a rotary power supply 80 such as an electric motor. Thus, when the electro-magnetic clutch is energized so that the rotary desk is engaged with the shaft 66, a power from the rotary power supply 80 is then transmitted to the shaft 66 so that the spindle 16 moves back and forth.

A sprocket 82 may be fitted onto the periphery of the inner sleeve 31 at the middle portion thereof and be driven from a rotary power supply 84 through a gearing 86 so that the spindle 16 is rotated. At that time, the electromagnetic clutch 72 is to be non-energized so that a rotational power applied to the inner sleeve 31 is not transmitted to the sprocket 76. A pressurizing plate 88 which may be lined with a frictional member 88*a* may be also secured to the reduced portion 16*a* of the spindle 16 at the base thereof for engaging against the reel flange. The pressurizing plate 88 may have any configuration such as a desk or rectangular plate.

In operation, the reel 12 is disposed in reel mounting means 10 so that the central axis of the reel is substantially aligned with those of the spindles 14 and 16. Thereafter, the end *b* of the wire *a* is extended through the opening 12*d* in one of the flanges 12*b* of the reel and led out of the flange. Then, the spindle 14 is advanced by actuation of the linear power supply 38 and the spindle 16 is simultaneously advanced by actuation of the rotary power supply 80. Thus, the reduced portions 14*a* and 16*a* of the spindles 14 and 16 are received into the axial hole 12*a* in the reel to mount the reel thereon while the pressurizing plate 50 forces the end of the wire against one of the flanges of the reel to hold it between the pressurizing plate and the corresponding flange of the reel. At that time, the pressurizing plate 88 is also forced against the other flange of the reel so that a rotational power is surely transmitted from the spindle to the reel 12. It will be noted that with the present invention since the wire end is secured to the reel flange at the same time that the reel is mounted, manual operation is not required by which the wire end is secured. Therefore, the reel mounting operation is simplified and the effectiveness in operation is improved. In addition, the wire is neither bended nor buckled, and is therefore not deteriorated. Furthermore, since the wire end is fixed only between the reel flange and the pressurizing plate, no damage is done to both the wire and the reel and therefore, the reel can be repetitively used. With the pressurizing plate engaging against at least one of the reel flanges, a deformation already taken to the reel flange if any, can be reformed and also an outward bend of the reel which tends to be produced due to the take up tension applied thereto during the wire take up operation can be prevented. It will be understood that this renders it possible to take up the wire on a reel having a relatively smaller physical strength such as plastic reel or a thinned and light reel. It will be understood that two pressurizing plates 50 and 88 preferably support the reel as afore-mentioned because it is more effective.

Figure 5:
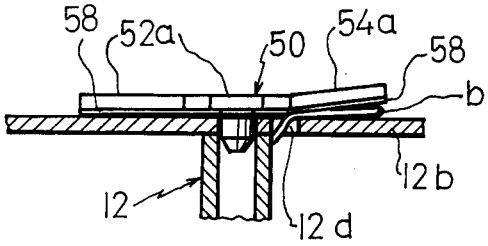
FIG. 5 schematically illustrates an end of a wire held between the pressurizing plate and the reel flange.

When the resilient pressurizing piece 54*a* of the wire end securing body 54 is forced against the reel flange 12*b* on mounting the reel, it is deflected as shown in FIG. 5 so that it is forced through the resilient frictional member 58 against the reel flange. Therefore, the relative position between the reel flange and the pressurizing plate 50 is fully fixed so that the reel flange pressurizing body 52 is never disengaged from the wire end, with the result that the wire take up can be smoothly accomplished to improve the effectiveness in the take up operation. The resilient pressurizing piece 54*a* may be preferably composed of materials such as spring steel which securely grasps the wire end by reaction of the piece because of its flexibility.

In this manner, after the reel is completely supported by reel mounting means 10, the electro-magnetic clutch 72 is deenergized and then the rotary power supply 84 is actuated to initiate taking up the wire on the drum 12*c* of the reel 12. When the wire has been sufficiently taken up on the reel, the rotary power supply is stopped and then the electro-magnetic clutch 72 is energized. At the same time, the rotary power supply 80 is re-actuated so as to reverse the threaded shaft 66 so that the spindle 16 is withdrawn while the linear power supply 38 is re-actuated so that the spindle 14 is withdrawn, whereby the reel containing the wires is removed from the reel mounting means 10.

Figure 6:
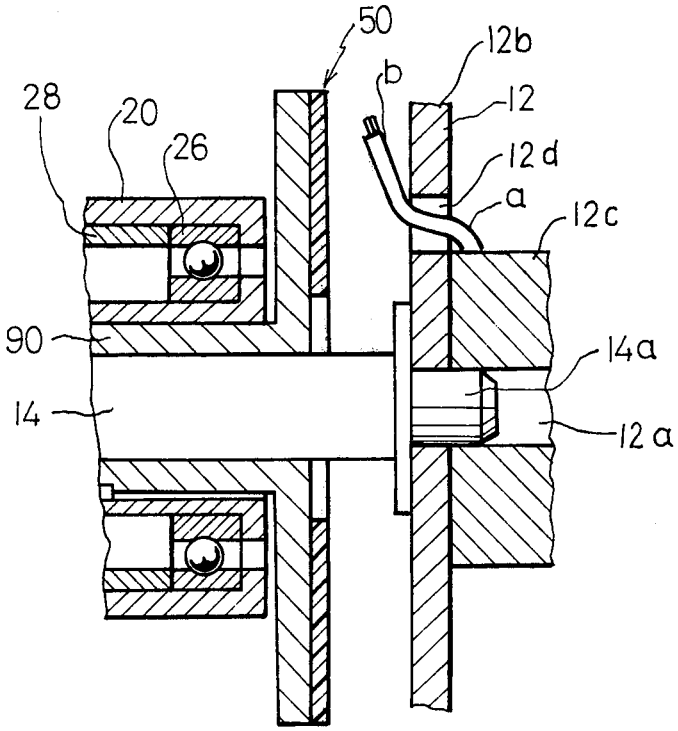
FIG. 6 is a fragmentary sectional view of another embodiment of reel mounting means.

FIG. 6 shows another embodiment of reel mounting means in accordance with the present invention, wherein the pressurizing plate 50 is slidably mounted on the spindle 14 so that the former can move independently of the latter. More particularly, a slidable sleeve 90 may be disposed between the inner sleeve 30 and the spindle 14 and coaxially and slidably engages the periphery of the spindle 14. The pressurizing plate 50 is secured to the slidable sleeve 90. Of course, a linear power supply (not shown) may be connected to the slidable sleeve 90 so that the pressurizing plate 50 may move back and forth independent from the forward and backward movemnet of the spindle. It will be noted that axial movement of the pressurizing plate 50 may be made at the same time of axial movement of the spindle 14 or in a delayed manner.

It will be understood that the reel may be driven from the side of the spindle 14 rather than from the side of the spindle 16. It will be also understood that the reel 12 on the right side of FIG. 1 may be journalled or supported by any conventional means instead of the pressurizing plate 50.

While some preferred embodiments of the present invention have been illustrated and described with reference to the accompanying drawings, it will be apparent from those skilled in the art that they are by way of examples and that various changes and modifications in construction and arrangement may be made without departing from the spirit and scope of the present invention, which is intended to be defined only to the appended claims.

What is claimed is:

1. Reel mounting means for a wire take up apparatus comprising a pair of spindles axially movable so that the opposing ends of said spindles are received into an axial hole in a reel and so that a wire extending through an opening in one of the flanges of said reel with the end of said wire leading out of said reel flange, is fixed between said reel flange and the corresponding spindle, characterized by that at least one of said spindles on the side thereof facing the corresponding reel flange is provided with a pressurizing plate comprising a reel flange pressurizing body including at least one armlike first pressurizing piece of rigid material extending radially from an annular base at an angular space to be forced against said reel flange, and a wire end securing body including at least one resilient second pressurizing piece provided individually from said first pressurizing piece to extend radially from said annular body and spaced individually in a circumferential direction from said first pressurizing piece to force said wire end against said corresponding reel flange whereby it is fixed between said pressurizing plate and said corresponding reel flange.

2. Reel mounting means for a wire take up apparatus comprising a pair of spindles axially movable so that the opposing ends of said spindles are received into an axial hole in a reel and so that a wire extending through an opening in one of the flanges of said reel with the end of said wire leading out of said reel flange, is fixed between said reel flange and the corresponding spindle, characterized by that at least one of said spindles on the side thereof facing the corresponding reel flange is provided with a pressurizing plate comprising a single circular first pressurizing piece of a rigid material and a lateral groove or opening in said circular pressurizing piece provided to face the opening in said reel flange so as to receive said wire end therein, and a wire end securing body including a second pressurizing piece provided individually from said first pressurizing piece to force said wire end received in said lateral groove or opening against said reel flange, a screw secured to said pressurizing piece of said wire end securing body to be threadedly mounted on said circular pressurizing piece of said reel flange pressurizing body, and means to rotate said screw so as to axially move it.

* * * * *